US005243723A

United States Patent [19]

Cotner et al.

[11] Patent Number: 5,243,723

[45] Date of Patent: Sep. 14, 1993

[54] MULTI CHAMBERED SEQUENTIALLY PRESSURIZED AIR MATTRESS WITH FOUR LAYERS

[75] Inventors: Ronald L. Cotner, Devoy, N.H.; Paul K. Blauchette, Lawrence, Mass.

[73] Assignee: Innovative Medical Systems, Inc., Hampton, N.H.

[21] Appl. No.: 855,302

[22] Filed: Mar. 23, 1992

[51] Int. Cl.[5] ..... A47C 27/10; A61G 7/057

[52] U.S. Cl. ..... 5/453; 5/455

[58] Field of Search ..... 5/453, 455, 456, 914, 5/469

[56] References Cited

U.S. PATENT DOCUMENTS

| | | | |
|---|---|---|---|
| 3,199,124 | 8/1965 | Grant | 5/453 |
| 4,149,285 | 4/1979 | Stanton | 5/453 |
| 4,175,297 | 11/1979 | Robbins et al. | 5/453 |
| 4,197,837 | 4/1980 | Tringali et al. | 5/453 |
| 4,225,989 | 10/1980 | Corbett et al. | 5/453 |
| 4,391,009 | 7/1983 | Schild et al. | 5/453 |
| 4,551,874 | 4/1985 | Matsumura et al. | 5/453 |
| 4,622,706 | 11/1986 | Takeuchi | 5/453 |
| 4,653,130 | 3/1987 | Senoue et al. | 5/453 |
| 4,745,647 | 5/1988 | Goodwin | 5/453 |
| 4,777,679 | 10/1988 | De Looper | 5/453 |
| 5,103,519 | 4/1992 | Hasty | 5/453 |
| 5,109,560 | 5/1992 | Uetake | 5/453 |

FOREIGN PATENT DOCUMENTS

| | | | |
|---|---|---|---|
| 2197192 | 5/1988 | United Kingdom | 5/453 |

*Primary Examiner*—Alexander Grosz
*Attorney, Agent, or Firm*—Don Halgren

[57] ABSTRACT

The present invention comprises an inflatable air mattress made up of four similar layers of pressurizable cells. The upper two layers are sequentially pressurizable with air pressure from a pressure generator. The lower two layers are under a constant pressure from the pressure generator. Each layer is divided into three square units containing a transversely disposed interdigitated pair of cells, to provide a wave-like motion to any patient on the mattress.

10 Claims, 3 Drawing Sheets

MULTI CHAMBERED SEQUENTIALLY PRESSURIZED AIR MATTRESS WITH FOUR LAYERS

BACKGROUND OF THE INVENTION (1) Field of the Invention

This invention relates to air mattresses, and more particularly to a multilayered air mattress having multiple chambers adapted to maximize the health and comfort for its user.

(2) Prior Art

Mattresses can be relaxing objects when a person may lie on one for a short time. However, if a person is bedridden, and relatively immobile, those mattresses can become creators of pain and infection.

Bed sores may develope on people at points of pressure between bony structures and the mattress. These bed sores are a breakdown of skin tissue due to interruption of blood flow, which are known as decubitous ulcers. These ulcers have four distinct stages: (1) reddened skin, (2) reddened skin and broken, vesiculated, or excoriated, (3) full thickness loss of skin which may include subcutaneous tissue and produces serosanguinous drainage, (4) full thickness loss of skin with invasion of deeper tissue.

Avoidance of this problem is accomplished primarily by lowering the pressure interface with respect to the patient's body. Patient comfort, mattress convenience and other factors should also be considered when designing an environment free of such problems, those other factors including minimization of moisture on the patient's skin to avoid maceration of it.

There have been a number of attempts to alleviate ulcers of the aforementioned type, with various air mattresses with varying degrees of success.

U.S. Pat. No. 3,199,124 to Grant shows an inflatable mattress with a layer of alternating pressurizable cells.

U.S. Pat. No. 4,149,285 to Stanton discloses an air support mattress having multi-membraned cells having aligned openings therethrough to provide an air stream.

U.S. Pat. No. 4,175,297 to Robbins et al shows an inflatable pillow which is controlled by a circuit to alternate pressure in alternate chambers.

U.S. Pat. No. 4,197,837 to Tringali et al discloses an inflatable pad in conjunction with a foam cushion to coact as a controlled air mattress.

U.S. Pat. No. 4,391,009 to Schild et al discloses a dual layer mattress having apertures to direct air out onto a patient.

U.S. Pat. No. 4,551,874 to Matsumura et al shows a massage mat having chambers which are sequentially pressurized.

U.S. Pat. No. 4,622,706 to Takeuchi discloses an air mattress which utilizes a curvilinear layer of foam in conjunction with tube-like air chambers for patient support.

It is an object of the present invention to provide an improvement in pressurizable air mattresses over the prior art.

It is a further object of the present invention to provide an air mattress which takes into consideration more than elimination of skin ulcer problems of a patient.

It is yet a further object of the present invention to provide an air mattress which is economical in its manufacture and upkeep, and has features not appreciated by the art.

BRIEF SUMMARY OF THE INVENTION

The present invention comprises a sequentially inflatable air mattress adapted particularly for long term use of bed ridden patients. The present air mattress is arranged so as to permit patient movement, comfort, and allow emergency CPR treatment to be given, and allow articulation of the mattress, for use in articulable beds.

The air mattress of the present invention is configured to conform to the standard hospital mattress size, 35 inches by 80 inches, when it is fully inflated.

The air mattress of the present invention comprises a multi layered arrangement of static pressure cells and dynamic pressure cells, all loosely encased in a breathable enveloping mattress case on which a patient would lie.

The static pressure cell arrangement comprises two identical lower layers of inflated cells. The dynamic cell arrangement comprises two identical upper layers of inflated cells.

Each layer of cells in this air mattress is identical, except for its pressure, to the layer of cells adjacent it. Each layer of cells is defined by an upper and a lower flexible plastic membrane (i.e., polypropylene or polyethylene about 1 to 3 mils thick) of generally rectangular shape. Each upper and lower membrane is welded by heat, fusion or adhesive, along its periphery, into a generally rectangularly shaped envelope having a head end and a foot end. Each upper and lower membrane is further welded transversely thereacross at two locations, to divide the rectangularly shaped envelope into three equal generally square units. The transverse welds permit the layers of cells to be articulated with respect to adjacent square units without pinching off pressure. Each generally square unit is welded further into a plurality of transversely extending interdigitating, sinusoidally configured pressurizable cells. Alternate pressurizable cells being in fluid communication with one another so as to define an inflated elongated cell adjacent a slightly deflated cell, when the alternate cells are sequentially pressurized.

The upper two layers of cells are pressurized correspondingly with one another, the vertically adjacent cells being pressurized and depressurized simultaneously, the two upper layers of cells therefore comprising the dynamic layers of the air mattress assembly.

The air mattress assembly, in its preferred embodiment has two lower layers of cells, which as aforementioned are identical to the upper two layers of cells, except that the two lower layers are constantly pressurized, at about 1 psi, above atmospheric.

A flexible conduit is arranged in fluid communication with each of the two pressurizable cells in each generally square unit. When the first one of cells in each generally square unit in each of the two upper layers of cells is pressurized to about 1 psi (above atmospheric), the second or other cell interdigitated with the first cell in each generally square unit is depressurized to about 0 psi.

The flexible conduits arranged to the upper two layers of cells are in fluid communication, with a regulatable pressure generator, which has valve means therein to direct pressurized fluid from the pressure source to the first one of the two cells in each generally square unit, then switching the pressure source to the second or other cell and simultaneously depressurizing the former cell, in each generally square unit of the upper two layers of cells.

The pressure generator is in fluid communication with the two lower layers of cells to keep a constant pressure of about 1.2 psi. (above atmospheric), therein.

The transverse edge of the head end of each upper layer of cells are connectively attached thereacross to one another by a flexible web of plastic welded therebetween. The foot end of each upper layer of cells is similarly attached to one another by a flexible web of plastic welded therebetween.

The transverse edge of the head end of each lower layer of cells are connectively attached thereacross to one another by a flexible web of plastic welded therebetween. The foot end of each lower layer of cells is similarly attached to one another by a flexible web of plastic welded therebetween.

The upper edge of the uppermost layer of cells at the head end thereof, is connected transversely thereacross to the lower edge of the lowermost layer of cells, by a flexible head web of plastic material. This head web of material keeps the upper (dynamic) and lower (static) layers of cells in vertical alignment with one another during patient use, and similarily, the webs of material between the respective upper layers and the respective lower layers, assuring alignment and patient comfort, and permits maximization of pressurized fluid flow between the pressure generator and the respective families of cells.

A plurality of air release holes are randomly disposed into the membranes which define the upper and lower surfaces of each of the families of cells, there being more air release holes in the upper dynamic layers than in the lower static layers. The air release holes permit continuous air loss from each of the cells to prevent them from becoming overpressurized, thereby regulating the air containment, while allowing a flow of air about the patient utilizing the air mattress assembly, evaporating moisture buildup therebetween.

The fluid conduits from the middle and head end generally square units on the two upper layers of cells are arranged with the pressure generator so as to rapidly deflate upon receipt of a rapid deflate signal of an on/off switch. The air is primarily released at the pressure generator itself instead of through just the air release holes in the membranes defining the respective layers. The rapid release of air from cells in the center and head end in the generally square units permits a firmer base for emergency treatment, such as cardiopulmonary resucitation (CPR) if/when such emergency treatment is necessary, on a patient on the mattress. This middle and head end cell depressurization first, permits the lowering and stabilization of the torso and head of a patient, desirably leaving the legs and feet in a raised configuration, to maximize the effect of any CPR procedure enacted on the patient.

The fluid conduits are placed on correspondingly similar locations, adjacent the foot end on one common side of each generally square unit, to establish a "wave" like motion as the pressure builds up and decreases in each pair of cells in each of those generally square units.

The invention thus comprises an air mattress assembly for use by a patient to maximize comfort and minimize the likelihood of bed sores thereon, by a varying pressure within the mattress, the assembly comprising a pair of variably pressurized uppermost layers of interdigitated cells, a pair of constantly pressurized lowermost layers of interdigitated cells, an arrangement of fluid conduits for conducting alternating or constant fluid pressure levels to adjacent interdigitated cells, and a pressure generator for providing both varying cycles of fluid pressure to said cells in said two uppermost layers of cells and a constant level of fluid pressure in said two lowermost layers of cells, whereby a wave-like sequential pressurization-depressurization takes place in said uppermost two layers, and a constant pressure is maintained in said two lower layers providing a stable base thereunder.

The method of manufacturing a pressurizable air mattress assembly of the present invention comprises the steps of: providing two flexible rectangularly shaped layers of plastic membrane, arranging said membranes into peripheral alignment with one another, welding said membranes together to define a rectangular periphery, welding said membranes together transversely thereacross to define at least two square units therein, welding a curvilinear weld across each of said square units to define at least a first and a second pressurizable cell in each of said square units, and attaching conduit means to each of said pressurizable cells between said membranes to permit pressurization thereof from a regulatable pressure generator, including arranging at least four layers said welded rectangularly shaped membranes into a vertical array, attaching the respective transverse ends of the upper two layers together with a flexible web of material, attaching the respective transverse end of the lower two layers together with a flexible web of material, attaching one end of the upper and lower layers together with a web of flexible material.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
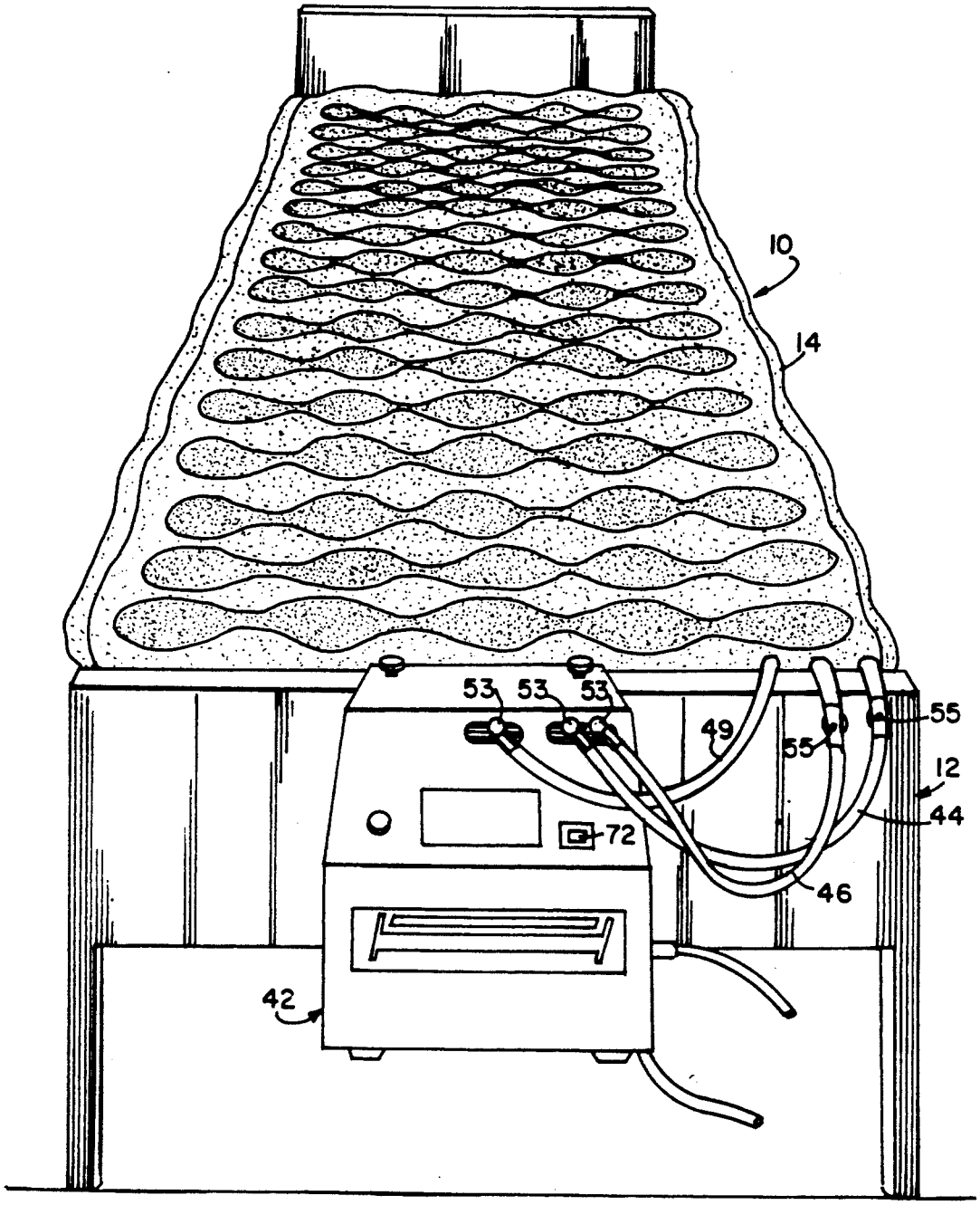
FIG. 1 is a perspective view of a bed having an inflatable air mattress of the present invention disposed thereon.

Referring now to the drawings in detail, and particularly to FIG. 1, there is shown an inflatable air mattress assembly 10 arranged on a bed and bed frame assembly 12. The air mattress assembly 10 of the preferred embodiment, comprises a plurality layers of the cell layer 14 shown in FIG. 2.

Figure 2:
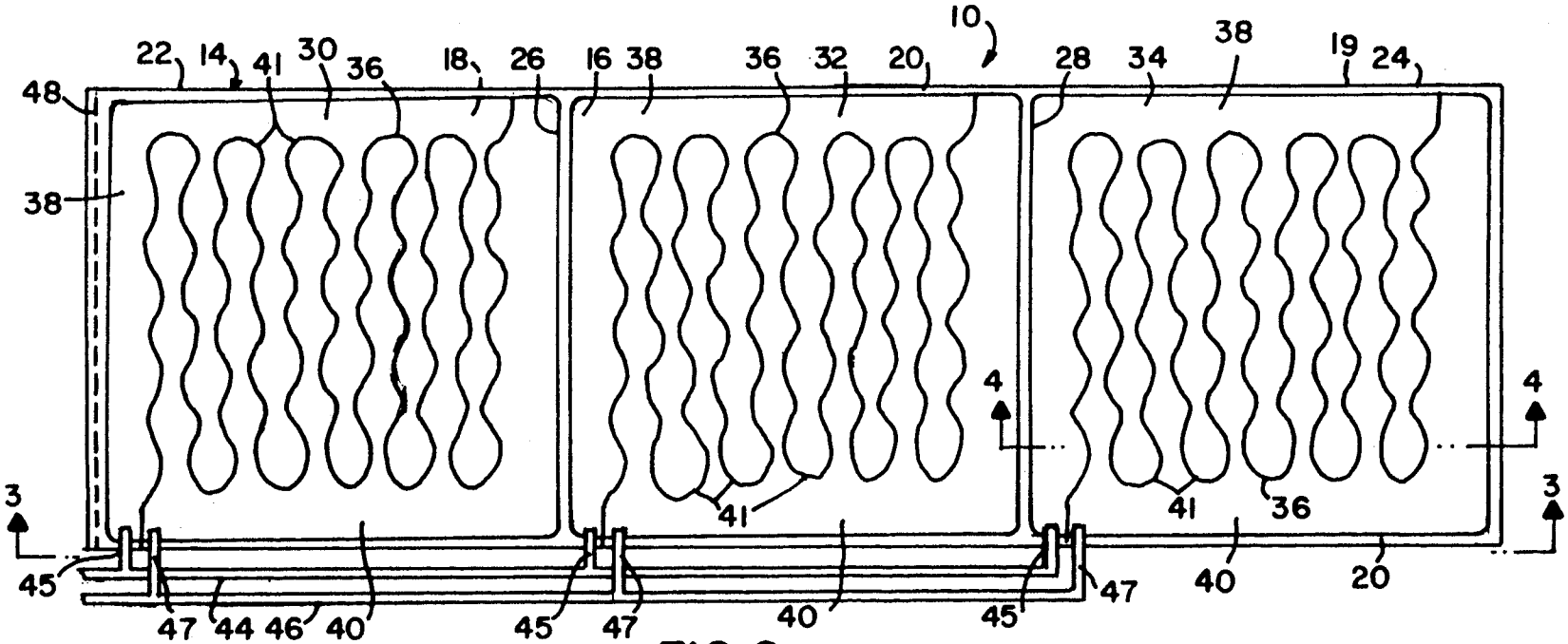
FIG. 2 is a plan view of the upper layer of the inflatable airmattress of the present invention.

Each cell layer 14 is made up of an upper rectangular membrane 16 and a lower rectangular membrane 18, of flexible plastic material (about 1 to 3 mils thick), having a final configured (inflated) dimension of about 35 inches wide by 80 inches long. Each cell layer 14 has its plastic membranes 16 and 18 welded together by heat, fusion or adhesive around its periphery 20, as shown in FIG. 2, into a generally rectangularly shaped envelope 19 having a head end 24 and a foot end 22. Each of the upper and lower membranes 16 and 18 are further welded together at transverse welds 26 and 28, so as to divide each of the respective generally rectangular envelopes 19 into three equal generally square units 30, 32 and 34, the transverse welds 26 and 28 permitting each cell layer 14 to be articulated or folded along the transverse welds 26 or 28 with respect to adjacent square units 30, 32 or 34 without pinching off fluid communication between one another, which will be more fully described hereinbelow.

Each generally square unit 30, 32 and 34 is also welded preferably by a single curvilinear (hairpin shaped) weld 36 joining the upper and lower membranes 16 and 18, into a pair of transversely extending interdigitating, sinusoidally configured first and second pressurizable cells 38 and 40, as best shown in FIG. 2. Each first and second pressurizable cell 38 or 40 has a finger-like configuration 41 where it abuts its adjacent neighboring cell 40 or 38 in each square unit 30, 32 or 34.

Each first pressurizable cell 38 in each square unit 30, 32 and 34 in the dynamic or upper two layers is in pressurizable fluid communication with a regulatable fluid pressure generator 42, as shown in FIG. 1, through an arrangement of flexible tubular fluid conduits 44 as shown in FIG. 2. Each second pressurizable cell 40 in each square unit 30, 32 and 34 in the dynamic or upper two layers, is also in pressurizable fluid communication with the pressure generator 42, through an arrangement of flexible conduits 46, shown in FIG. 2.

The first pressurizable cells 38 in each square unit 30, 32 and 34 are pressurized to about 1 psi., and then depressurized to about 0 psi., by a syncronous valve, not shown, in the fluid pressure generator 42. As the first pressurizable cell 38 is being deflated, the second pressurizable cell 40 is being inflated synchronously, in each square unit 30, 32 and 34, to create a wave-like motion within the finger-like configurations 41 arranged therebetween. In the view shown in FIG. 4, each set of cells 38 and 40 are shown pressurized for ease of viewing.

In the preferred embodiment, only the two top cell layers 14 are dynamically cycled through a pressurization-depressurization period. The inflatable air mattress assembly 10 also includes at least two lower static cell layers 14 in which both cells 38 and 40 in each, are maintained at a constant pressure of about 1.2 psi. pressure, through a flexible condiut 49, shown in FIG. 1.

Figure 3:
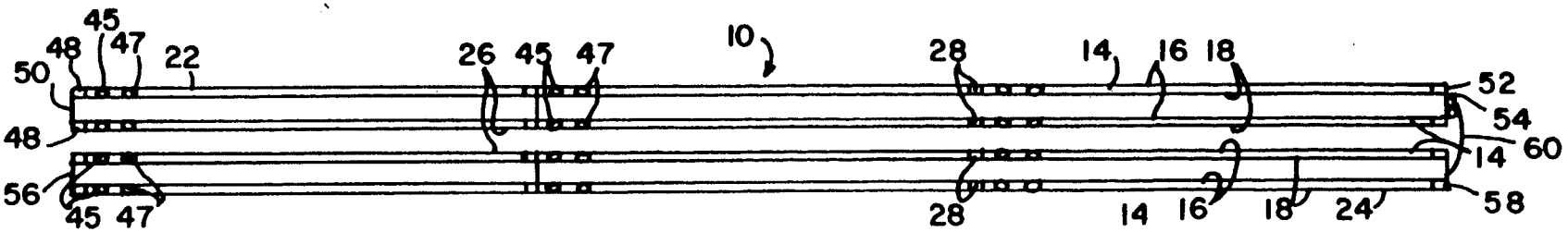
FIG. 3 is a view taken along the lines III—III of FIG. 2.
Figure 4:
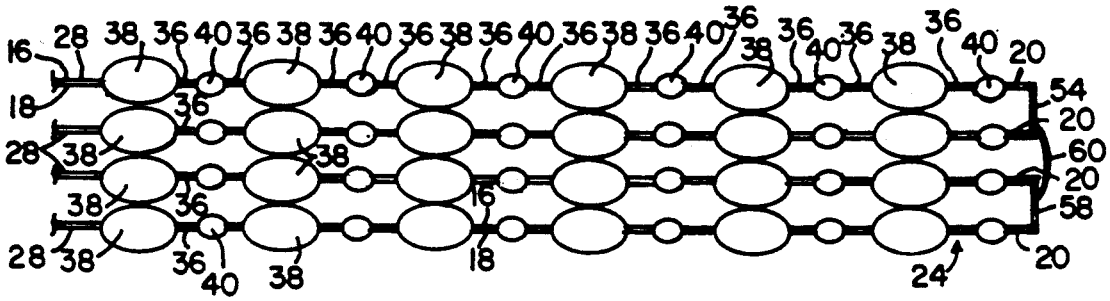
FIG. 4 is a view taken along the lines IV—IV of FIG. 2.

The head end 24 of the two dynamic cell layers 14 have a transverse edge 52 which have a flexible plastic web 54 secured thereacross, as shown in FIGS. 3 and 4. The foot end 22 of each dynamic cell layer 14 also has a transverse edge 48 across which a flexible plastic web 50 is secured by welding, or the like.

The two static cell layers 14 have a flexible plastic web 58 joined across their transverse edges at their head end 24 and a flexible plastic web 56 joined across their transverse edges at their foot end 22.

The flexible webs 54 and 50 on the head and foot ends 24 and 22 of the dynamic cell layers 14 prevent relative movement therebetween.

The flexible webs 58 and 56 on the head and foot ends 24 and 22 of the static cell layers 14 also prevent relative movement therebetween.

A further plastic flexible web 60 is disposed between the two upper dynamic cell layers 14 and the two lower static cell layers 14, as shown in FIGS. 3 and 4. The flexible plastic web 60 is on only the head end 24 of the air mattress assembly, to prevent bunching up and kinking of the dynamic upper two cell layers 14 with respect to the static lower two cell layers 14, if the air mattress assembly 10 is angled in a movable bed. The flexible plastic web 60 and the other connecting webs 50, 54, 56 and 58 keep the upper and lower cell layers 14 in relative vertical alignment during the critical initial period of (motionless) patient care.

Figure 5:
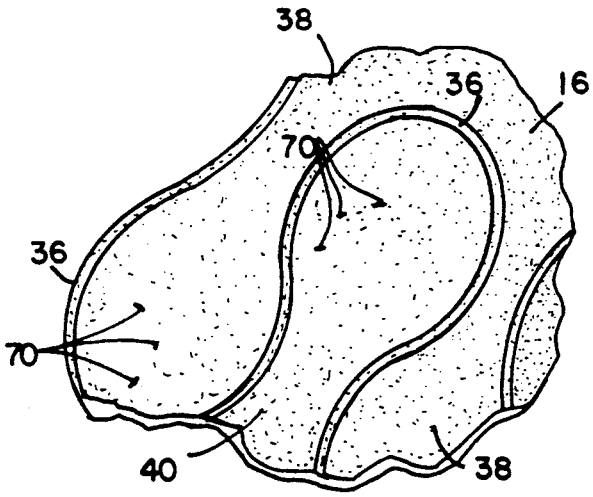
FIG. 5 is an enlarged plan view of a portion of some pressurized cells of this invention.

A plurality of air release holes 70 are disposed through both membranes 16 and 18 which comprise the upper and lower surfaces of each cell layer 14. The air release holes 70, shown in FIG. 5, permits slight continuous air loss from each of the interdigitated cells 38 and 40, to prevent them from becoming overpressurized, thereby regulating the air containment, while allowing a flow of air about the patient, as the cells 38 and 40 create the blood circulation enhancing wave-like (sequential pressurization-depressurization) motion thereunder.

The fluid conduits 44 and 46 from the head end square unit 34 and the middle square unit 32 in the upper two cell layers 14 are arranged, by virtue of their sequence in the conduits from the pressure generator 42, to deflate first, upon receipt of a dump signal from a rapid deflate switch 72 to enable emergency care such as CPR, to be administered to a patient on the air mattress assembly 10. The releasing of the air pressure from the cells 38 and 40 in the head and middle square units 34 and 32 also allows the foot of any patient to be maintained in a higher level, to maximize the effects of any such CPR treatment on such patient.

The fluid conduits 44 and 46 are placed on correspondingly similar locations of each square unit 30, 32 and 34, as may be seen in FIGS. 2 and 3, so as to facilitate the wave-like motion as the pressure builds up and decreases across each square unit 30, 32 and 34 in the dynamic upper two cell layers 14. The fluid conduits 44 and 46 each have a one way valve 55 disposed therein, as shown in FIG. 1, to permit the air pressure in the cells 38 and 40 to remain somewhat constant in the event of sudden loss of electrical power to the console or pressure generator 42 or if the air lines are disconnected at a quick disconnect valve 53 at the console 42 to permit a patient to be moved while still on the mattress.

The fluid conduits 44, 46 and 49 have nipples 45 and 47 which extend from the conduits 44, 46 and 49, through the peripheral weld 20 between the upper and lower membranes 16 and 18, and into their respective cells 38 and 40 to provide the air communication from the console to the cells 38 and 40.

Thus there has been shown a unique air mattress assembly which provides a wave-like messaging of a patient thereon. The air mattress assembly having at least four similar independent layers of pressurizable cells, the upper two layers having adjacent cells which are pressurized and depressurized sequentially, from a controllable pressure generator, the lower two layers being under constant pressure to provide columnar vertical support for their vertically adjacent pressurized cells, each layer being divided into square units to permit folding of the air mattress assembly without pinching off of any air flow therealong.

We claim:

1. An air mattress assembly for use by a patient to maximize comfort and minimize the likelihood of bed sores thereon, by a varying pressure within the mattress, the assembly comprising:

a pair of variably pressurized uppermost dynamic layers of interdigitated cells, said layers joined together at their respective transverse end edges, by a web of flexible plastic, to prevent relative movement therebetween;

a pair of constantly pressurized lowermost static layers of interdigitated cell, said layers joined together at their respective transverse edges, by a web of flexible plastic;

wherein said dynamic layers of cells and said static layers of cells each have a head end, and said head end of said dynamic layers and said head end of said static layers have a web of flexible plastic material joining them together to prevent relative movement of said dynamic layers with respect to said static layers;

an arrangement of fluid conduits for conducting alternating or constant fluid pressure levels to adjacent interdigitated cells; and a pressure generator for providing both varying cycles of fluid pressure to said cells in said two uppermost layers of cells and a constant level of fluid pressure in said two lowermost layers of cells, whereby a wave-like sequential pressurization-depressurization takes place in said uppermost two layers, and a constant pressure is maintained in said two lower layers providing a stable base thereunder.

2. An air mattress assembly as recited in claim 1, wherein each of said layers of cells are comprised of an uppermost flexible membrane and a lowermost flexible membrane, which are welded at their common outmost periphery into a generally rectangular sandwich configuration.

3. An air mattress assembly as recited in claim 2, wherein said rectangular sandwich of flexible membranes have at least one transverse weld thereacross, so as to divide said layer into at least two square units, to facilitate folding of said layers along said transverse weld without pinching said layers and hindering the pressurization-depressurization of said cells in each of said layers.

4. An air mattress assembly as recited in claim 3, wherein each of said square units has a curvilinear weld thereacross to define at least a first and a second pressurizable cell between each upper and lower membrane.

5. An air mattress assembly as recited in claim 4, wherein said curvilinear weld defines said two cells having finger-like interdigitating portions extending transversely across each of said square units, to facilitate a wave-like motion in said cell layers in the uppermost layers of said assembly.

6. An air mattress assembly as recited in claim 5, wherein said upper and lower membranes comprising each layer, have air release holes therein, to permit slow release of pressurized air from said pressurized cells and to prevent moisture build-up on said assembly.

7. An air mattress assembly as recited in claim 6, wherein said pressure generator has a rapid discharge switch to permit said two upper dynamic layers of cells to deflate rapidly to allow prompt emergency treatment of any patient thereon.

8. An air mattress assembly as recited in claim 7, wherein said first pressurizable cells in each of said square units are in fluid communication with one another to permit pressure equalization therebetween.

9. An air mattress as recited in claim 8, wherein said second pressurizable cells in each of said square units are in fluid communication with one another to permit pressure equalization therebetween.

10. An air mattress as recited in claim 9, wherein each of said square units has its fluid conduit connection in a correspondingly similar location on the periphery of said square units.

* * * * *